United States Patent [19]

Shigeru et al.

[11] Patent Number: 5,044,137

[45] Date of Patent: Sep. 3, 1991

[54] JOINING METHOD AND STRUCTURE IN A WOODEN BUILDING

[76] Inventors: Terada Shigeru, 1-20-31, Rokumanji-cho, Higashiosaka-Osaka; Shu Terada, 3-602,22, Nishijuku 2-chome, Minoo-shi, Osaka, both of Japan

[21] Appl. No.: 589,700

[22] Filed: Sep. 28, 1990

[30] Foreign Application Priority Data

Sep. 29, 1989 [JP] Japan ..... 1-256743

[51] Int. Cl.[5] ..... E04H 12/18

[52] U.S. Cl. ..... 52/286; 52/646; 52/648; 403/172

[58] Field of Search ..... 52/285, 286, 645, 646, 52/648; 403/171-176, 217; 135/99, 106; 446/110-112, 105-108, 122

[56] References Cited

U.S. PATENT DOCUMENTS

| | | | |
|---|---|---|---|
| 2,156,155 | 4/1939 | Howard | 52/648 |
| 4,280,521 | 7/1981 | Zeigler | 135/106 |
| 4,863,305 | 9/1989 | Schold | 403/171 |

FOREIGN PATENT DOCUMENTS

| | | | |
|---|---|---|---|
| 0216429 | 1/1987 | European Pat. Off. | 52/648 |
| 1098717 | 3/1955 | France | 135/106 |
| 345534 | 6/1937 | Italy | 52/283 |

*Primary Examiner*—James L. Ridgill, Jr.
*Attorney, Agent, or Firm*—Koda and Androlia

[57] ABSTRACT

In a structure and method for joining post and beams, the post has a joint projected at the end. The joint is of a square cross section and is axially shifted 45 degrees. A vertical groove is provided along the diagonal line of the joint. End portions of the beams have grooves deep in the longitudinal direction thereof, and strips having a plurality of holes arranged on a straight line from one end to the other are securely inserted in the grooves of the beams. The beams are arranged end to end with the joint in-between so that the strips are inserted through the groove of the joint and entered in the grooves of the opposite beams, and the beams and the post are securely connected via pins driven through the holes of the strips.

8 Claims, 8 Drawing Sheets

JOINING METHOD AND STRUCTURE IN A WOODEN BUILDING

BACKGROUND OF THE INVENTION

1. Field of the Invention

The present invention relates to a joining method and structure used in a wooden building.

2. Prior Art

A joining structure disclosed in Japanese Patent No. 11,463,413 (Publication No. 57-37739) developed by the inventor of the present application is as follows: a transverse member such as a beam, a foundation and the like are provided with bolt holes near opposite ends without a joint and another bolt hole at the center of the end surface along the wood fiber direction. Also, the transverse member has a projection of a rectangular cross section which locates at the end and continues from top face to bottom face. A post member has a bolt hole corresponding to the bolt hole of the transverse member perpendicular to the wood fiber direction, having one to four dents of shape and size corresponding to the projection of the transverse member at opposite ends. The above transverse member and the post member are connected by a bolt-and-nut.

SUMMARY OF THE INVENTION

With the structure described above in mind, it is the general object of the present invention to provide a method and a structure of a wooden building which can make shapes of the connecting sections of the post and transverse member much simpler, making working hours at a construction site shorter.

The above-described object of the present invention is accomplished by unique structures as described below:

A post employed is made up with a main body of a square cross section and a joint projected on a step portion of the top or bottom of the main body. The joint has a square cross section and is axially shifted 45 degrees in relation to the main body. A deep downward groove is provided along the diagonal line on the section of the joint.

First and second transverse members are installed on the post so that these members contact at their ends to the step portion of the main body.

Each of the transverse members has a post joint surface, which comes into contact with adjacent two side surfaces of the joint. Transverse joint surfaces are respectively formed horizontally next to the post joint surfaces of the transverse members. At the center of the horizontal direction of the post joint surface, a groove which is deep in the longitudinal direction of each transverse member is provided.

A first strip, which has first, second and third holes arranged on a straight line from one end to the other, is inserted in the groove of the first transverse member. The first strip is securely fixed to the first transverse member by a first bolt-and-nut through the first hole which is near the bottom of the groove.

A second strip, which has first, second and third holes arranged on a straight line from one end to the other, is inserted in the groove of the second transverse member. The second strip is securely fixed to the second transverse member by a second bolt-and-nut through the first hole which is near the bottom of the groove.

A first pin pointed at one end penetrates the first transverse member through the second hole of the first strip and the third hole of the second strip.

A second pin pointed at one end penetrates the second transverse member through the second hole of the second strip and the third hold of the first strip.

With the elements above, the first and second transverse members are arranged in series (or continuously) with the joint in-between. Each of the first and second strip is inserted through the groove of the joint so that they are parallel and next to each other and then positioned in the groove of the transverse members, respectively. The first and second pins ar driven through the second holes and through the third holes of the first and second strips, respectively.

Four transverse members can be joined crosswise with the post in-between. In this case, similar to the first and the second transverse members positioned on the left and right sides, third and fourth transverse members are positioned in the front and back sides of the joint, respectively. Also, similar to the first and second strips, third and fourth strips are securely fixed to the third and fourth transverse members, respectively, by a third and fourth bolt-and-nut. In addition to the first and the second pins, a third pin and a fourth pin are used so that they penetrate the third and fourth transverse members, respectively.

Furthermore, three beams can be joined in T with the post in-between. In this case, along with the first and second transverse members which are positioned on the left and right sides, a third transverse member is installed on the front side of the joint. A third strip is securely fixed to the third transverse member by third bolt-and-nut, and a third pin is penetrated in the third transverse member. In addition, a fourth strip is employed. The fourth strip has a hole at one end and a fourth stopper plate at the other end. The stopper plate has an extending surface perpendicular to the fourth strip.

When assembled, the third transverse member and the fourth strip are arranged in series with the joint in-between, and the third and fourth strips pass through the groove of the joint parallel and adjacent to each other. The fourth strip is inserted in the groove of the third transverse member, and the third pin is driven through the second hole of the third strip and through the hole of the fourth strip.

Furthermore, two beams can be joined in L with the post in-between. This structure is basically an arrangement of the third transverse member described above in the T-shaped joint that is turned 90 degrees.

In other embodiments, a post can include a main body of a square cross section and on its top is formed a projected joint of a square cross section which is coaxial with and is the same posture as the main body. A downwardly or upwardly deep groove is formed along the bisector of each sectional side of the joint.

DETAILED DESCRIPTION OF THE INVENTION

Figure 1:
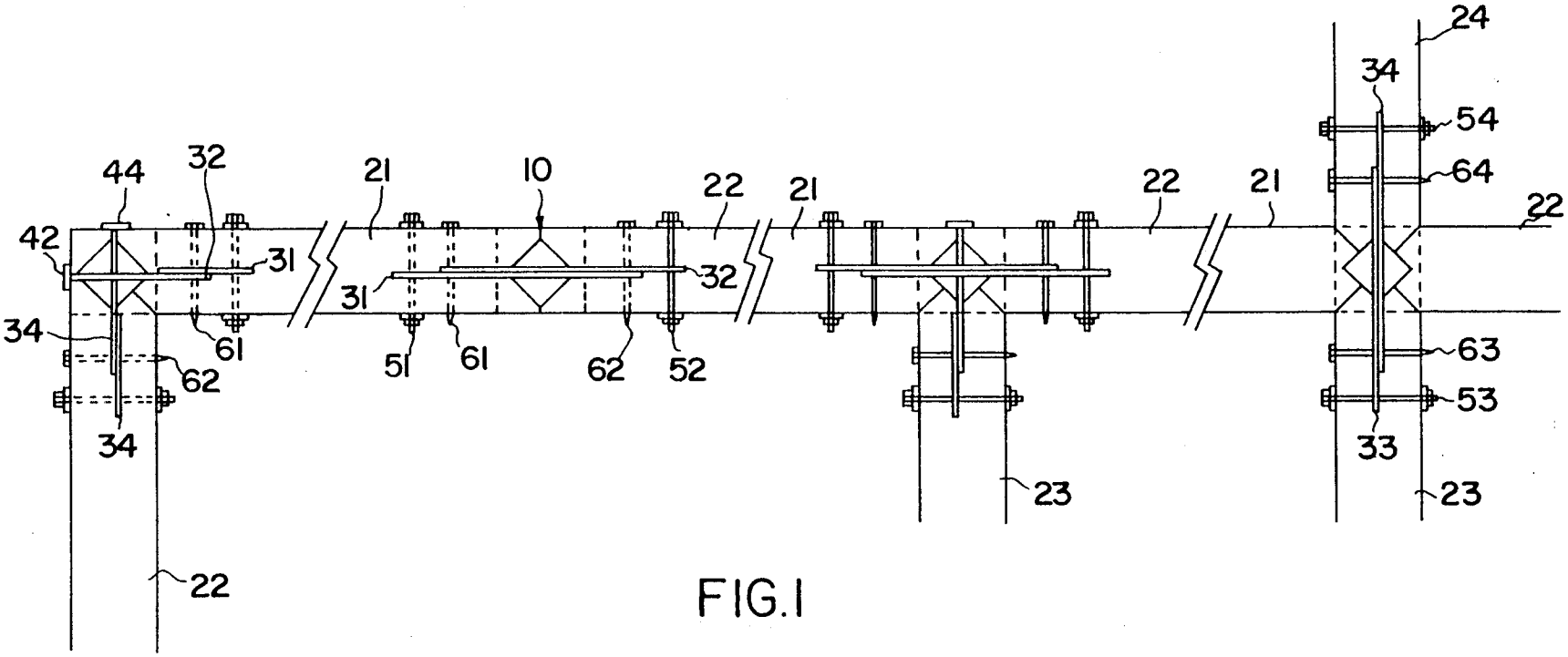
FIG. 1 shows a plan view of one embodiment of the joining structure according to the present invention.
Figure 2:
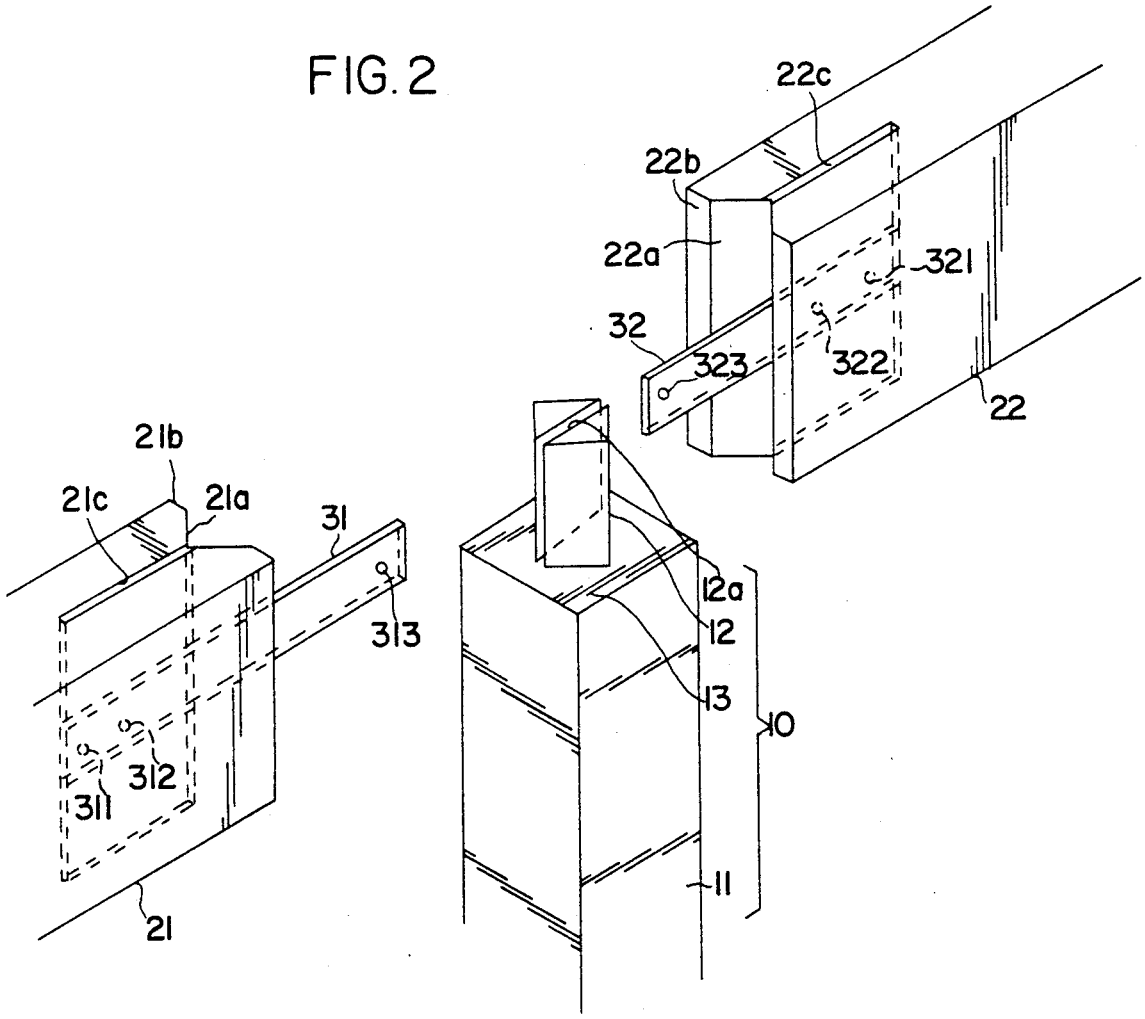
FIGS. 2, 3, 4 and 5 each shows an enlarged fragmentary perspective view of FIG. 1.

FIG. 1 shows a junction between a post and a beam, and FIG. 2 shows two beams connected in series.

Post 10 is made up with a main body 11 of a square cross section and a joint 12 projected on a step portion 13 of the main body 11. The joint 12 has a square cross section and is axially shifted 45 degrees in relation to the main body 11. A deep downward groove 12*a* is provided along the diagonal line on the section of the joint 12.

First and second transverse beams 21 and 22 are supported at their end on the step portion 13 of the main body 11.

The transverse beams 21 and 22 have a post joint surface 21*a* and 22*a*, respectively, which comes into contact with two side surfaces of the joint 12. Transverse joint surface 21*b* and 22*b* are formed respectively next to the post joint surface 21*a* and 22*a* of the transverse beams 21 and 22. At the center of the horizontal direction of the post joint surface 21*a* and 22*a* is provided a groove 21*c* and 22*c* which are deep in the longitudinal direction of the transverse beams 21 and 22.

A first strip 31 has first, second and third holes 311, 312, and 313, arranged on a straight line from one end to the other and inserted in the groove 21*c* of the first transverse beam 21. The first strip 31 is securely fixed to the first transverse beam 21 by a first bolt-and-nut 51 through the first hole 311 which is near the deepest end of the groove 21*c*.

A second strip 32 has first, second and third holes 321, 322 and 323 arranged on a straight line from one end to the other and inserted in the groove 22*c* of the second transverse beam 22. The second strip 32 is securely fixed to the second transverse beam 22 by a second bolt-and-nut 52 through the first hole 321 which is near the deepest end of the groove 22*c*.

A first pin 61 pointed at one end penetrates the first transverse beam 21 through the second hole 312 of the first strip 31 and the third hole 323 of the second strip 32.

A second pin 62 pointed at one end penetrates the second transverse member 22 through the second hole 322 of the second strip 32 and through the third hole 313 of the first strip 31.

The first and second transverse beams 21 and 22 are arranged in series with the joint 12 in-between. Each of the first and second strips 31 and 32 are inserted through the groove 12*a* of the joint 12 parallel and next to each other and then placed in the groove of the transverse beam 22 and in the groove of the transverse beam 21, respectively. The first and second pins 61 and 62 are driven through the second holes 312 and 322 and through the third holes 313 and 323 of the first and second strips 31 and 32, respectively.

Figure 3:
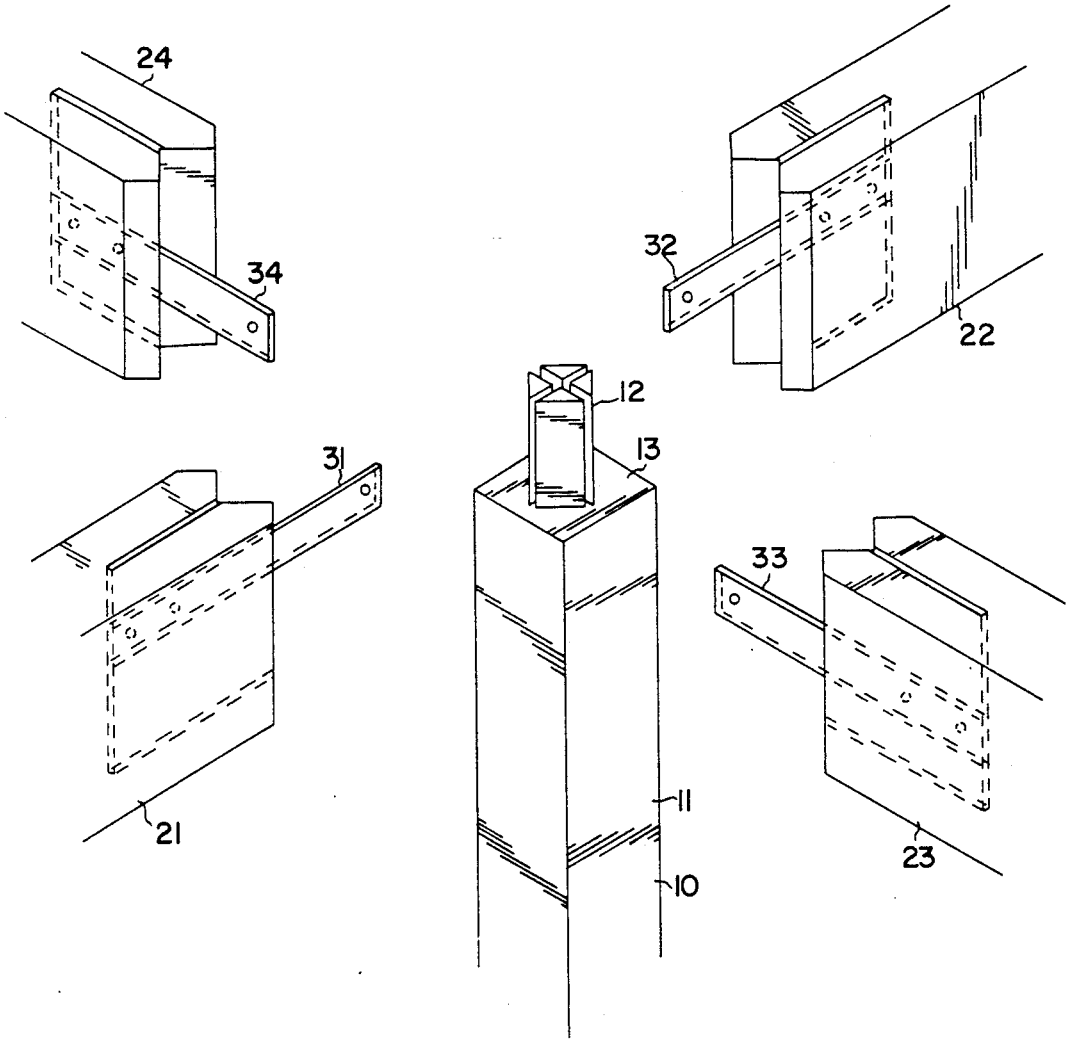

FIG. 3 shows that four beams are joined crosswise with the post 10 in-between. Similar to the first and the second transverse beams 21 and 22 positioned on the left and right side, third and fourth transverse beams 23 and 24 are positioned front and back, respectively. Also similar to the first and the second strips 31 and 32, a third and a fourth strips 33 and 34 are securely fixed to the third and fourth transverse beams 23 and 24, respectively, by a third and fourth bolt-and-nut 53 and 54. Similar to the first and second pins 61 and 62, third 63 and fourth pins 64 penetrate the third and the fourth transverse beams 23 and 24, respectively.

Figure 4:
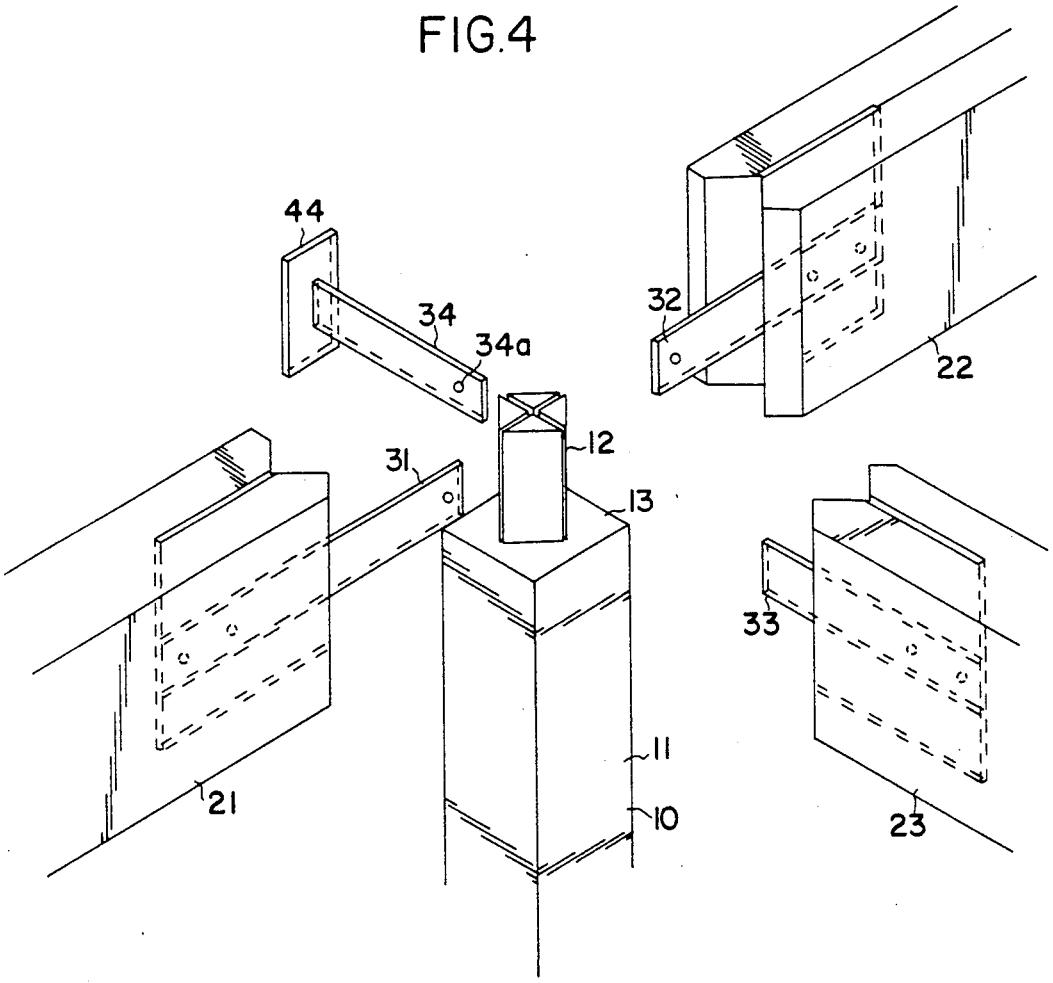

FIG. 4 shows three beams jointed in T with the post 10 in-between. Similar to the first and the second transverse beams 21 and 22 which are positioned on the left and right sides, a third transverse beam 23 is positioned on the front side of the joint 12.

Similar to the first and second strips 31 and 32, a third strip 33 is securely fixed to the third transverse beam 23 by third bolt-and-nut 53 (see FIG. 1). Similar to the first and the second pins 61 and 62, a third pin 63 penetrates the third transverse beam 23. A fourth strip 34 has a hole 34*a* at one end and a fourth stopper plate 44 at the other end with its extending surface perpendicular to the fourth strip 34.

The third transverse beam 23 and the fourth strip 34 are arranged in series with the joint 12 in-between, and the third and the fourth strips 33 and 34 passing through the groove of the joint 12 parallel and adjacent to each other. The fourth strip 34 is inserted in the groove of the third transverse beam 23, and the third pin 63 is driven through the second hole of the third strip 33 and through the hole 34*a* of the fourth strip 34.

Figure 5:
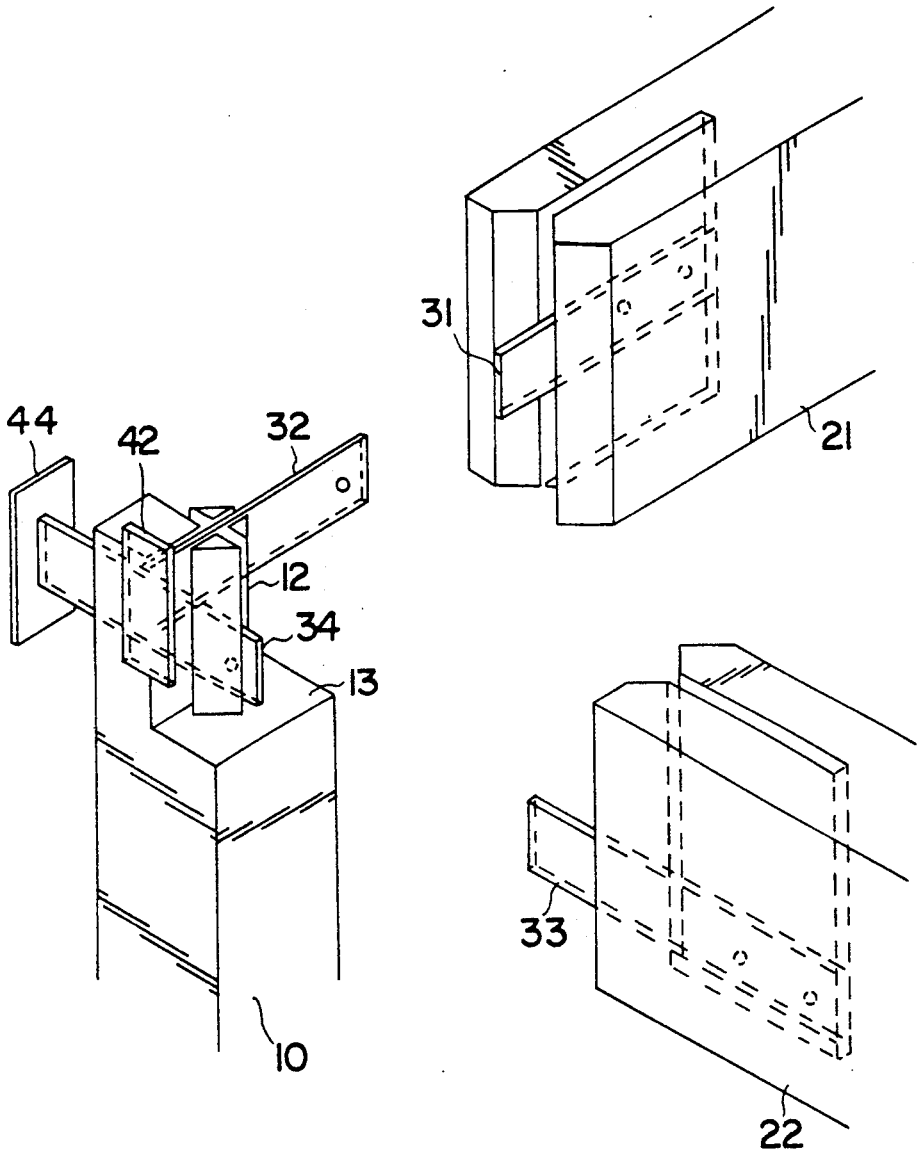
Figure 6:
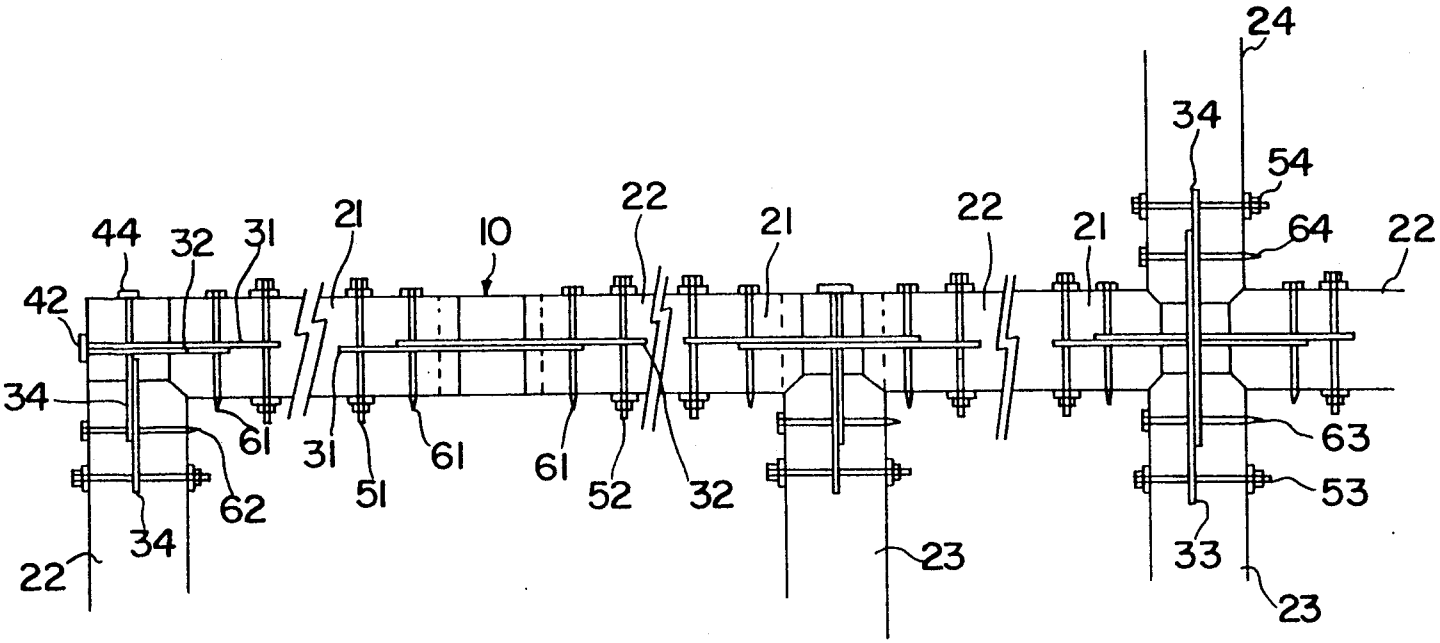
FIG. 6 shows a plan view of another embodiment of joining structure according to the present invention.

In FIG. 5, two beams are jointed in L with the post 10 in-between, and this is basically an arrangement of FIG. 4 turned 90 degrees.

Next, one embodiment of the joining method is explained with reference to FIG. 2.

The first and the second strips 31 and 32 are securely coupled to the first and second transverse beams 21 and 22 by the first and second bolt-and-nut 51 and 52 (see FIG. 1). When the first transverse beam 21 is positioned horizontally, the first strips 31 is inserted in the groove 12*a* of the joint 12, and the joining end of the first transverse beam 21 is supported on the step portion 13 of the post 10. The second strip 32 is then inserted in the groove of the joint 12 from the top, and the end portion of the second transverse beam 22 is supported on the step portion 13.

Next, through the second hole 312 of the first strip 31 and through the third hole 323 of the second strip 32, the first pin 61 is driven into the first transverse beam 21. Similarly, the second pin 62 is driven into the second transverse beam 22.

In this case, since both holes of the strips 31 and 32 are shifted slightly in the longitudinal direction of the transverse beam, by passing the pointed ends of the pins 61 and 62 through these holes, the pins pull one strip together with one transverse beam so that the holes are matched coaxially. As a result, the two transverse beams are pulled to each other to make a contact with the joint 12 of the post 10. Other joining parts are connected similarly.

FIGS. 6, 7, 8, 9 and 10, show other embodiments, the post joint having substantially the same posture as the post body. The post 10 includes a main body 11 of a square cross section which is coaxial with the post body.

A downwardly deep groove 12*a* is formed along the bisector of each sectional side of the joint 12.

Figure 7:
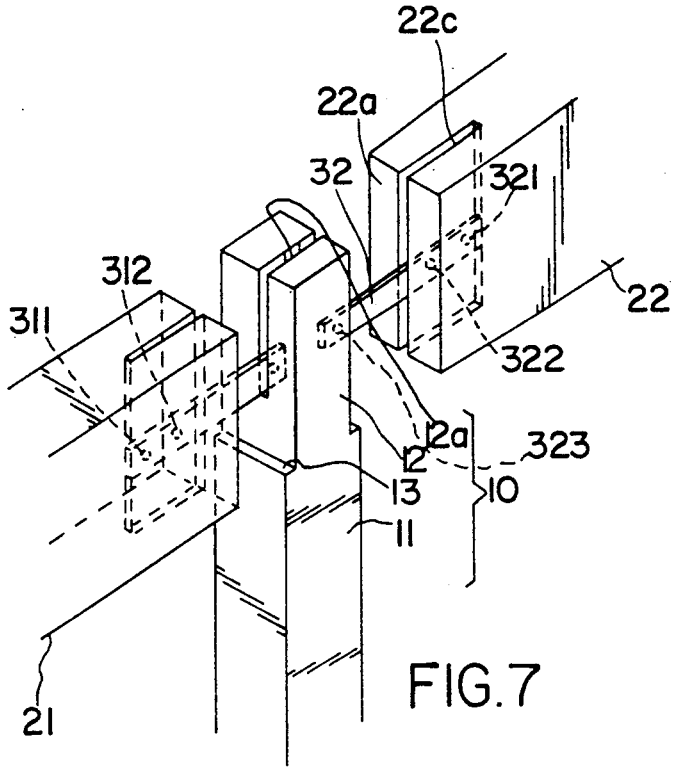
FIGS. 7, 8, 9 and 10 each shows an enlarged fragmentary perspective view of FIG. 6.

In FIG. 7, the first and second transverse beams 21 and 22 are supported at their end of the step portion 13 of the post 10. The transverse beams 21 and 22 have a post joint surfaces 21*a* and 22*a* which are in contact with the side surface of the joint 12. At the center in the horizontal direction of the post joint surface 21*a* and 22*a* are provided with grooves 21*c* and 22*c* respectively which are deep in the longitudinal direction of the transverse beam.

Figure 9:
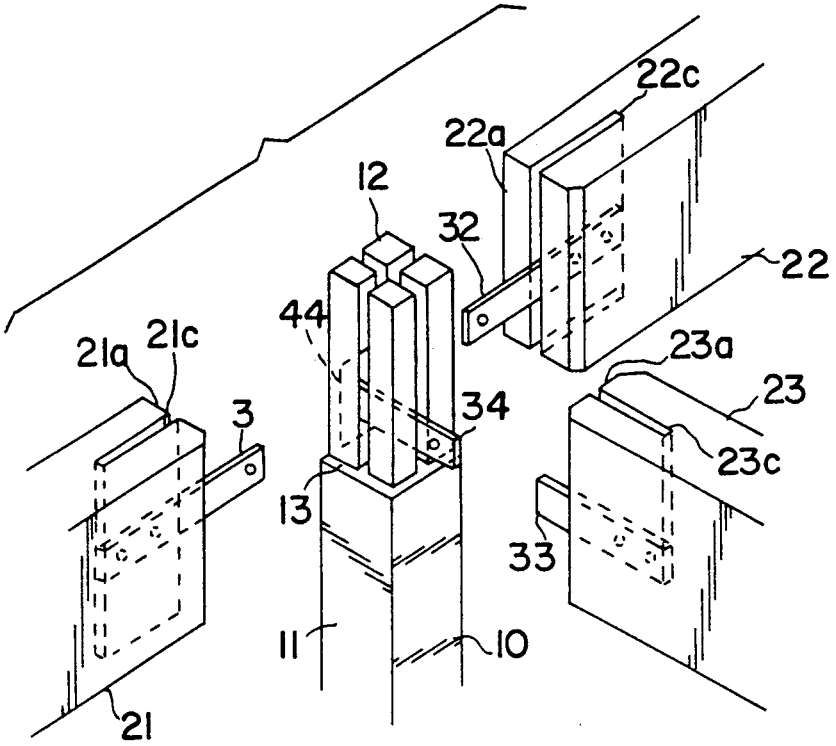

In FIG. 9, the first, second, and third transverse beams 21, 22 and 23 have a post joint surface 21*a*, 22*a* and 23*a* at the end, each contacting each of the side surfaces of the joint 12. Each of these transverse beams 21, 22 and 23 also have a groove 21*c*, 22*c* and 23*c* along with a transverse joint surface 21*b*, 22*b* and 23*b* in which are next to the post joint surface 21*a*, 22*a*, and 23*a*, in the horizontal direction.

Figure 8:
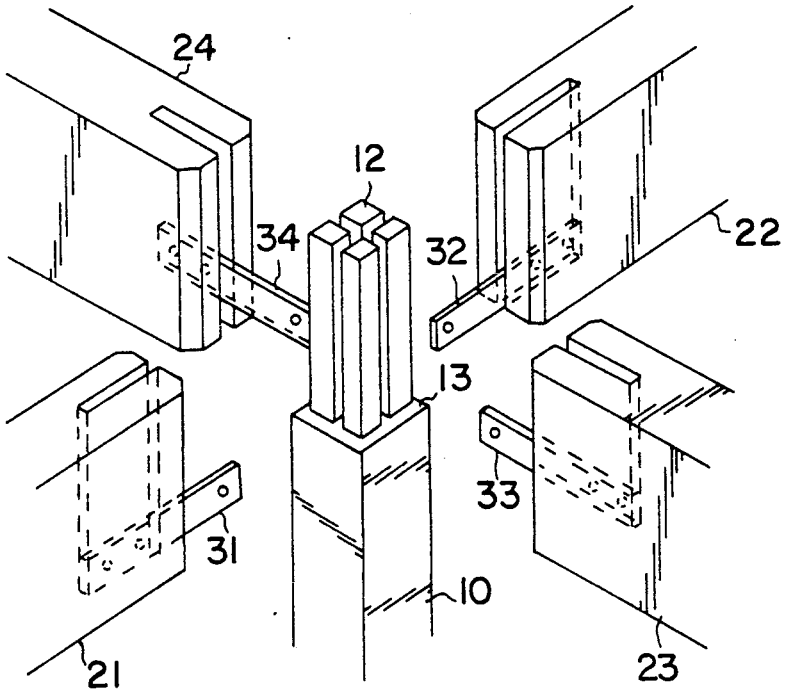
Figure 10:
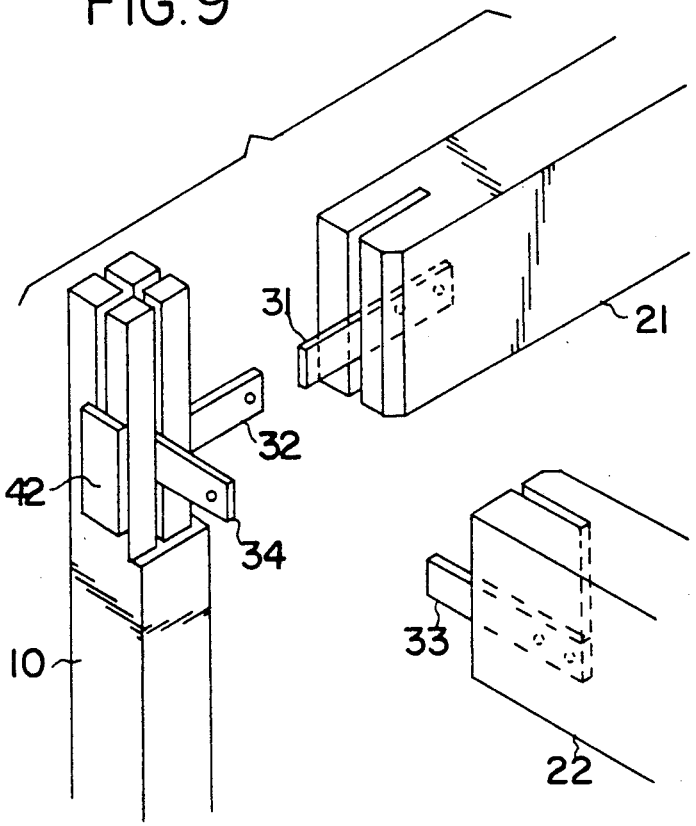

Embodiments in FIGS. 8 and 10 are structured in the same manner as described above.

The present invention can be applied to a foundation secured on a pedestal and other transverse members.

It is possible to design different embodiments without departing from the spirit and scope of this invention, and it should be understood that the present invention is not limited to the embodiments described in the specification.

As described above, according to the present invention, shapes of the connecting part of the post and the transverse beams are much simpler compared to the prior art structure. The post and transverse beams are manufactured in a sawmill very easily and simply. Thus, production efficiency is high, and connecting work at a construction site can be very easy.

A wooden building constructed by the method of the present invention is excellent in solidity and stability, has minimal warp, and requires no extra operation such as correction of warp, etc. Therefore, uniform structure can be built at minimal cost.

Even when connection the post members of the present invention to other construction members, these members can be mass produced, keeping production costs to a minimum.

Also, since connections are made via two strips, two bolt-and-nuts, and two pins, the jointing force in the longitudinal direction of the transverse member is great. Moreover, the force acting of the transverse direction of the transverse beams can be supported by strips and the joint surface between the post and the transverse member, and the transverse members can be supported on the step portion of the post, creating higher stability.

The uniformity of the building is achieved by the unskilled art.

We claim:

1. A joining structure in a wooden building comprising:

a post comprising a main body of a square cross section and a joint projected on a step portion of a top or bottom of said main body, said joint having a square cross section and being axially shifted 45 degrees in relation to said main body, and deep downward or upward groove being provided along the diagonal line on the section of said joint;

first and second transverse members contacting at their ends to said step of said main body, said transverse members having a post joint surface, respectively, which comes into contact with two side surfaces of said joint and transverse joint surfaces respectively, formed horizontally next to said post joint surfaces, at the center of the horizontal direction of said post joint surface being provided with a groove which is deep in the longitudinal direction of said transverse members;

a first strip having first, second and third holes arranged on a straight line from one end to the other and inserted in said groove of said first transverse member, said first strip being securely fixed to said first transverse member by a first bolt-and-nut through said first hole which is near the bottom of said groove;

a second strip having first, second and third holes arranged on a straight line from one end to the other end inserted in said groove of said second transverse member, said second strip being securely fixed to said second transverse member by a second bolt-and-nut through said first hole which is near the bottom of said groove;

a first pin pointed at one end penetrating said second transverse member through said second hole of said first strip and through said third hole of said first strip; and a second pin pointed at one end penetrating said second transverse members through said second hole of said second strip and through said third hole of said first strip;

wherein said first and second transverse members are arranged in series with said joint in-between, each of said first and second strips is inserted through said groove of said joint parallel and next to each other and then placed in said groove of said transverse members, and said first and second pins are driven through said second holes and through said third holes of said first and second strips, respectively.

2. A joining structure in a wooden building comprising:

a post comprising a main body of a square cross section and a joint projected on a step portion of a top or bottom of said main body, said joint having a square cross section and being axially shifted 45 degrees in relation to said main body, and a deep downward or upward groove being provided along the diagonal line on the section of said joint;

first and second transverse members contacting at their end to said step of the main body, said transverse members having a post joint surface, respectively, which comes into contact with two side surfaces of said joint and transverse joint surfaces respectively formed horizontally next to said post joint surfaces, and at the center of the horizontal direction of said post joint surface being provided a groove which is deep in the longitudinal direction of said transverse members;

a first strip having first, second and third holes arranged on a straight line from one end to the other and inserted in said groove of said first transverse member, said first strip being securely fixed to said first transverse member by a first bolt-and-nut through said first hole which is near bottom of said groove;

a second strip having first, second and third holes arranged on a straight line from one end to the other and inserted in said groove of said second transverse member, said second strip being securely fixed to said second transverse member by a second bolt-and-nut through said first hole which is near the bottom of said groove;

a first pin pointed at one end penetrating said second transverse member through said second hole of said first strip and through said third hole of said second strip; and a second pin pointed at one end penetrating said second transverse member through said second hole of said second strip and through said third hole of said first strip;

wherein said first and second transverse members are arranged in series with said joint in-between, each of said first and second strips are inserted through said groove of said joint parallel and next to each other and then placed in said groove of said transverse member, and said first and second pins are driven through said second holes and through said third holes of said first and second strips, respectively, said structure further comprising;

third and fourth transverse members positioned front and back, respectively, similar to said first and second transverse members positioned on the left and right sides;

third and fourth strip securely fixed to said third and fourth transverse members, respectively, by third and fourth bolt-and-nut, respectively, similar to said first and said second strips; and third and fourth pins penetrating said third and said fourth transverse members, respectively, similar to said first and said second pins.

3. A joining structure in a wooden building comprising:

a post comprising a main body of a square cross section and a joint projected on a step portion of a top or bottom of said main body, said joint having a square cross section and being axially shifted 45 degrees in relation to said main body, and a deep downward or upward groove being provided along the diagonal line on the section of said joint;

first and second transverse members contacting at their ends to said step of said main body, said transverse members having a post joint surface, respectively, which comes into contact with adjacent two side surfaces of said joint and transverse joint surfaces, respectively, formed horizontally next to said post joint surfaces, and at the center of horizontal direction of said post joint surface being provided a groove which is deep in a longitudinal direction of said transverse members;

a first strip having first, second and third holes arranged on a straight line from one end to the other and inserted in said groove of said first transverse member, said first strip being securely fixed to said first transverse member by a first bolt-and-nut through said first hole which is near a bottom of said groove;

a second strip having first, second and third holes arranged on a straight line from one end to the other and inserted in said groove of said second transverse member, said second strip being securely fixed to said second transverse member by a second bolt-and-nut through said first hole which is near a bottom of said groove;

a first pin pointed at one end penetrating said second transverse member through said second hole of said first strip and through said third hole of said second strip; and a second pin pointed at one end penetrating said second transverse member through said second hole of said second strip and through said third hole of said first strip;

wherein said first and second transverse members are arranged in series with said joint in-between, each of said first and second strips are inserted through said groove of said joint parallel and next to each other and then placed in said groove of said transverse members, and said first and second pins are driven through said second holes and through said third holes of said first and second strips, respectively, said structure further comprising;

a third transverse member positioned on the front side of said joint, similar to said first and said second transverse members which are being positioned on the left and right sides;

a third strip securely fixed to said third transverse member by a third bolt-and-nut, similar to said first and second strips;

a third pin penetrating said third transverse member similar to said first and said second pins;

a fourth strip having hole at one end;

a fourth stopper plate fitted at the other end of said fourth strip with its extending surface perpendicular to said strip; and said third transverse member and said fourth strip are arranged in series with said joint in-between, said third and said fourth strips pass through said groove of said joint parallel and adjacent to each other, said fourth strip is inserted in said groove of said third transverse member, and said third pin is driven through said second hole of said third strip and through said hole of said fourth strip.

4. A joining structure in a wooden building comprising:

a post comprising a main body of a square cross section and a joint projected on a step portion of a top or bottom of said main body, said joint having a square cross section and being axially shifted 45 degrees in relation to said main body, a deep downward or upward groove being provided along the diagonal line on the section of said joint;

a first transverse member contacting at its end on said step portion of said main body, said transverse member having a post joint surface, which comes into contact with two side surfaces of side joint, and a transverse joint surface formed horizontally next to said post joint surface, at the center of the horizontal direction of said post joint surface being provided a groove which is deep in the longitudinal direction of the transverse member;

a first strip having first, second and third holes arranged on a straight line from one end to the other and inserted in said groove of said first transverse member, said first strip being securely fixed to said first transverse member by a first bolt-and-nut through said first hole which is near the bottom of said groove;

a second strip having a hole at one end;

a second stopper plate fitted at other end of said strip with its extending surface perpendicular to said strip; and a first pin pointed at one end penetrating said first transverse member through said second hole of said first strip and through said hole of said second strip;

wherein said first transverse member and said second strip are arranged in series with said joint in-between, said first and said second strips pass through said groove of said joint parallel and adjacent to each other, said second strip is inserted in said groove of said first transverse member, and said first pin is driven through said second hole of said first strip and through said hole of said second strip, said structure further comprising;

a second transverse member positioned on a front side of said joint, similar to said first and said second transverse member which are positioned on the left and right sides;

a third strip securely fixed to said second transverse member by a second bolt-and-nut, similar to said first strips, a fourth strip having a hole at one end;

a fourth stopper plate fitted at the other end of said fourth strip with its extending surface perpendicular to said strip; and a second pin pointed at one end penetrating said second transverse member similar to said first pin.

5. A joining structure in a wooden building comprising:

a post comprising a main body section and a joint projected on a step portion of a top or bottom of said main body, said joint having the same posture coaxially in relation to said main body, and a deep downward or upward groove being provided along the diagonal line on the section of said joint;

first and second transverse members contacting at their ends to said step of said main body, said transverse members having a post joint surface, respectively, which comes into contact with two side surfaces of said joint and transverse joint surfaces respectively formed horizontally next to said post joint surfaces, and at the center of the horizontal direction of said post joint surface being provided a groove which is deep in a longitudinal direction of said transverse members;

a first strip having first, second and third holes arranged on a straight line from one end to the other and inserted in said groove of said first transverse member, said first strip being securely fixed to said first transverse member by a first bolt-and-nut through said first hole which is near a bottom of said groove;

a second strip having first, second and third holes arranged on a straight line from one end to the other and inserted in said groove of said second transverse member, said second strip being securely fixed to said second transverse member by a second bolt-and-nut through said first hole which is near a bottom of said groove;

a first pin pointed at one end penetrating said second transverse member through said second hole of said first strip and through said third hole of said second strip; and a second pin pointed at one end penetrating said second transverse member through said second hole of said second strip and through said third hole of said first strip;

wherein said first and second transverse members are arranged in series with said joint in-between, each of said first and second strips is inserted through said groove of said joint parallel and next to each other and then placed in said groove of said transverse members, and said first and second pins are driven through said second holes and through said third holes of said first and second strips, respectively.

6. A joining structure in a wooden building comprising:

a post comprising a main body of a square cross section and a joint projected on a step portion of a top or bottom of said main body, said joint having a square cross section and being coaxially the same posture in relation to said main body, and a deep downward or upward groove being provided along the diagonal line on the section of said joint;

first and second transverse members contacting at their end to said step of the main body, said transverse member having a post joint surface, respectively, which comes into contact with two side surfaces of said joint and transverse joint surfaces, respectively, formed horizontally next to said post joint surfaces, and at the center of the horizontal direction of said post joint surface being provided a groove which is deep in longitudinal direction of the transverse members;

a first strip having first, second and third holes arranged on a straight line from one end to the other and inserted in said groove of said first transverse member, said first strip being securely fixed to said first transverse member by a first bolt-and-nut through said first hole which is near the bottom of said groove;

a second strip having first, second and third holes arranged on a straight line from one end to the other and inserted in said groove of said second transverse member, said second strip being securely fixed to said second transverse member by a second bolt-and-nut through said first hole which is near a bottom of said groove;

a first pin pointed at one end penetrating said second transverse member through said second hole of said first strip and through third hole of said second strip; and second pin pointed at one end penetrating said second transverse member through said second transverse member through said second hole of said second strip and through said third hole of said first strip;

wherein said first and second transverse members are arranged in series with said joint in-between, each of said first and second strips are inserted through said groove of said joint parallel and next to each other and then placed in said groove of said transverse members, and said first and second pins are driven through said second holes and through said third holes of said first and second strips, respectively, said structure further comprising;

third and fourth transverse members positioned front and back, respectively, similar to said first and second transverse members positioned on left and right side, respectively;

third and fourth strips securely fixed to said third and fourth transverse members, respectively, by a third and fourth bolt-and-nuts similar to said first and said second strips; and third and fourth pins penetrating said third and said fourth transverse members, respectively, similar to said first and said second pins.

7. A joining structure in a wooden building comprising:

a post comprising a main body of a square cross section and a joint projected on a step portion of a top or bottom of said main body, said joint having a square cross section and being coaxially the same posture in relation to said main body, and a deep downward or upward groove being provided along the diagonal line on the section of said joint;

first and second transverse members contacting at their ends to said step of said main body, said transverse members having a post joint surface, respectively, which comes into contact with two side surfaces of said joint and transverse joint surfaces, and at the center of horizontal direction of said post joint surface being provided a groove which is deep in a longitudinal direction of the transverse members;

a first strip having first, second and third holes arranged on a straight line from one end to the other and inserted in said groove of said first transverse member, said first strip being securely fixed to said first transverse member by a first bolt-and-nut through said first hole which is near the bottom of said groove;

a second strip having first, second and third holes arranged on a straight line from one end to the other and inserted in said groove of said second transverse member, said second strip being securely fixed by a second bolt-and-nut through said first hole which is near a bottom of said groove;

a first pin pointed at one end penetrating said second transverse member through said second hole of said first strip and through said third hole of said second strip; and a second pin pointed at one end penetrating said second transverse member through said second hole of said second strip and through said third hole of said first strip;

wherein said first and second transverse members are arranged in series with said joint in-between, each of said first and second strips is inserted through said groove of said joint parallel and next to each other and then placed in said groove of said transverse members, said first and second pins are driven through said second holes and through said third holes of said first and second strips, respectively, said structure further comprising;

a third transverse member positioned on a front side of said joint, similar to said first and said second transverse members which are positioned on left and right sides;

a third strip securely fixed to said third transverse member by a third bolt-and-nut, similar to said first and second strips;

a third pin penetrating said third transverse member similar to said first and second pins;

a fourth strip having a hole at one end; and a fourth stopper plate fitted at the other end of said fourth strip with its extending surface perpendicular to said strip;

wherein said third transverse member and said fourth strip are arranged in series with said joint in-between, said third and said fourth strips pass through said groove of said joint parallel and adjacent to each other, said fourth strip is inserted in said groove of said third transverse member, and said third pin is driven through said second hole of said third strip and through said hole of said fourth strip.

8. A joining structure in a wooden building comprising:

a post comprising a main body of a square cross section and a joint projected on a step portion of a top or bottom of said main body, said joint having a square cross section and being coaxially the same posture in relation to said main body, and a deep downward or upward groove being provided along the diagonal line on the section of said joint;

a first transverse member contacting at its end on said step portion of the main body, said transverse member having a post joint surface which comes into contact with two side surfaces of said joint, and transverse joint surface formed horizontally next to said post joint surface, and at the center in the horizontal direction of said post joint surface being provided a groove which is deep in the longitudinal direction of said transverse member;

a first strip having first, second and third holes arranged on a straight line from one end to the other and inserted in said groove of said first transverse member, said first strip being securely fixed by a first bolt-and-nut through said first hole which is near a bottom of said groove;

a second strip having a hole at one end;

a second stopper plate being fitted at the other end of said strip with its extending surface perpendicular to said strip; and a first pin pointed at one end penetrating said first transverse member through said second hole of said first strip and through hole of said second strip;

wherein said first transverse member and said second strip are arranged in series with said joint in-between, said first and said second strips pass through said groove of said joint parallel and adjacent to each other, said second strip is inserted in said groove of said first transverse member, and said first pin is driven through said second hole of said first strip and through said hole of said second strip, said structure further comprising;

a second transverse member positioned on a front side of said joint, similar to said first and said second transverse members which being positioned on left and right sides;

a third strip being securely fixed to said second transverse member by a second bolt-and-nut, similar to said first strips;

a fourth strip having a hole at one end;

a fourth stopper plate fitted at the other of said fourth strip with its extending surface perpendicular to said strip; and a second pin pointed at one end penetrating said second transverse member similar to said first pin.

* * * * *